US006131348A

United States Patent [19]

Dunham

[11] Patent Number: 6,131,348

[45] Date of Patent: Oct. 17, 2000

[54] TRIM WITH TEARAWAY MASKING STRIP

[75] Inventor: Wesley H. Dunham, Renton, Wash.

[73] Assignee: Beadex Manufacturing Company, Inc., Auburn, Wash.

[21] Appl. No.: 09/365,459

[22] Filed: Aug. 2, 1999

[51] Int. Cl.[7] ..... E04B 2/00

[52] U.S. Cl. ..... 52/287.1; 52/98

[58] Field of Search ..... 52/287.1, 300, 52/98, 108, 717.04

[56] References Cited

U.S. PATENT DOCUMENTS 5,048,247 9/1991 Weldy ..... 52/287.1

5,131,198 7/1992 Ritchie et al. ..... 52/287.1

5,604,001 2/1997 Schold ..... 52/287.1 X 5,974,746 11/1999 Mathias ..... 52/287.1 X

*Primary Examiner*—Jerry Redman

*Attorney, Agent, or Firm*—Richard W. Seed; Seed IP Law Group PLLC

[57] ABSTRACT

A trim strip has an angle strip with flanges meeting at an elbow and is covered with a paper strip having a tearaway wing extending laterally beyond one of the flanges at a line of perforations. The wing can be folded back at the perforations over the adjacent flange to project away from the elbow to provide a masking portion which can be severed at the perforations by pulling on the masking portion after the masking need is satisfied.

8 Claims, 2 Drawing Sheets

TRIM WITH TEARAWAY MASKING STRIP

TECHNICAL FIELD

The present invention relates to angle trim strips used in drywall construction to dress over the edge of a drywall panel which is separated by a narrow gap from a face of a ceiling or wall, panel, or a column, mullion, sill, or other member. More particularly, the invention relates to such trim strips of the type having a removable masking element for protecting an adjoining surface from splash over of spackle or paint being applied during the finishing process for dressing over the trim strip.

BACKGROUND OF THE INVENTION

Corner beads used as trim strips in drywall construction are normally either a "nail-on" type or a "tape-on" type. Nail-on beads commonly take the form of an angle strip of metal with side flanges meeting at a center corner rib providing shoulders against which spackle or joint cement can be dressed when feathered from the adjoining wall surfaces to cover the edges and outer faces of the side flanges and the heads of the nails securing these flanges to the wall structure. These nails are usually driven through the bead flanges at intervals of no more than eight inches.

Tape-on corner beads utilize paper wings to secure a metal corner angle in position rather than using nails. These wings are lateral extensions of a paper cover strip which is bonded by a hot melt glue or other suitable adhesive to the metal corner angle, usually on the outer faces of the side flanges. Spackle or joint cement and wall paint for dressing and finishing the corner, normally adhere significantly better to the paper cover strip of tape-on beads than to the exposed metal of nail-on beads. Also, normally drywall corners covered with nail-on beads are more susceptible to developing crack lines along the outer edges of the side flanges than when tape-on beads are used. On the other hand, nail-on beads have the advantage of requiring less skill to apply.

Corner beads are used not only to cover outside and inside corners at the intersections of wallboard panels, but also, to cover the raw edge of a vertical wallboard panel which is spaced by a narrow gap from a ceiling or other building part. In such an instance normally one of the bead flanges overlies the panel edge and the other flange overlaps the adjoining panel face. The latter flange is normally dressed over by spackle or joint, cement, and paint during a finishing operation. There is a need during this finishing operation to cover the ceiling or other related building part so as to protect it from being spattered by the finishing materials. This has been done in the past by applying masking tape independently of the corner bead or by providing the bead with a removable masking element projecting oppositely from the bead flange which covers the panel edge.

For example, in U.S. Pat. No. 4,074,478 a nail-on type of angle trim made of vinyl has a tearaway strip extending integrally from the elbow of the trim, thereby forming a generally T-shaped product. The tearaway strip is severed after installation of the trim by tearing it away at a score line formed at the trim elbow.

U.S. Pat. No. 5,243,797 discloses a nail-on type of metal corner bead having two metal flanges meeting at an elbow and having one of these flanges wider than the other one and doubled back over itself to provide a slot at the overlap for holding a masking strip of paper or thin metal which projects beyond the elbow to provide a masking portion. After the finishing operation the masking strip is pulled free of the slot.

The Beadex Manufacturing Company, Renton, Wash., has manufactured and sold a tape-on strip known as the "Jambex Pre-Mask" in which one of the paper wings of a tape-on corner bead has been widened so that it could be doubled back over itself to provide a masking portion extending oppositely from the elbow of the bead relative to the metal flange to which the wing is attached. After the finishing operation the masking portion is removed by cutting it along the elbow of the trip strip with a razor blade knife. The principal object of the present invention is to provide an improved tape-on angle trim having an integral tearaway masking element that can easily be removed without using a cutting tool and leaves a finished appearance at the elbow of the strip.

SUMMARY OF THE INVENTION

In accordance with the present invention, a corner bead has a paper wing doubled back along a fold line at the outer edge of the metal flange to which it is attached. The doubled-back portion is wide enough to project as a masking element away from the elbow of the bead. At or adjacent to the fold line, the paper is perforated so that the masking element can be easily removed merely by manually pulling on it such as to tear away the related paper wing at the perforations.

DETAILED DESCRIPTION OF THE INVENTION

Figure 1:
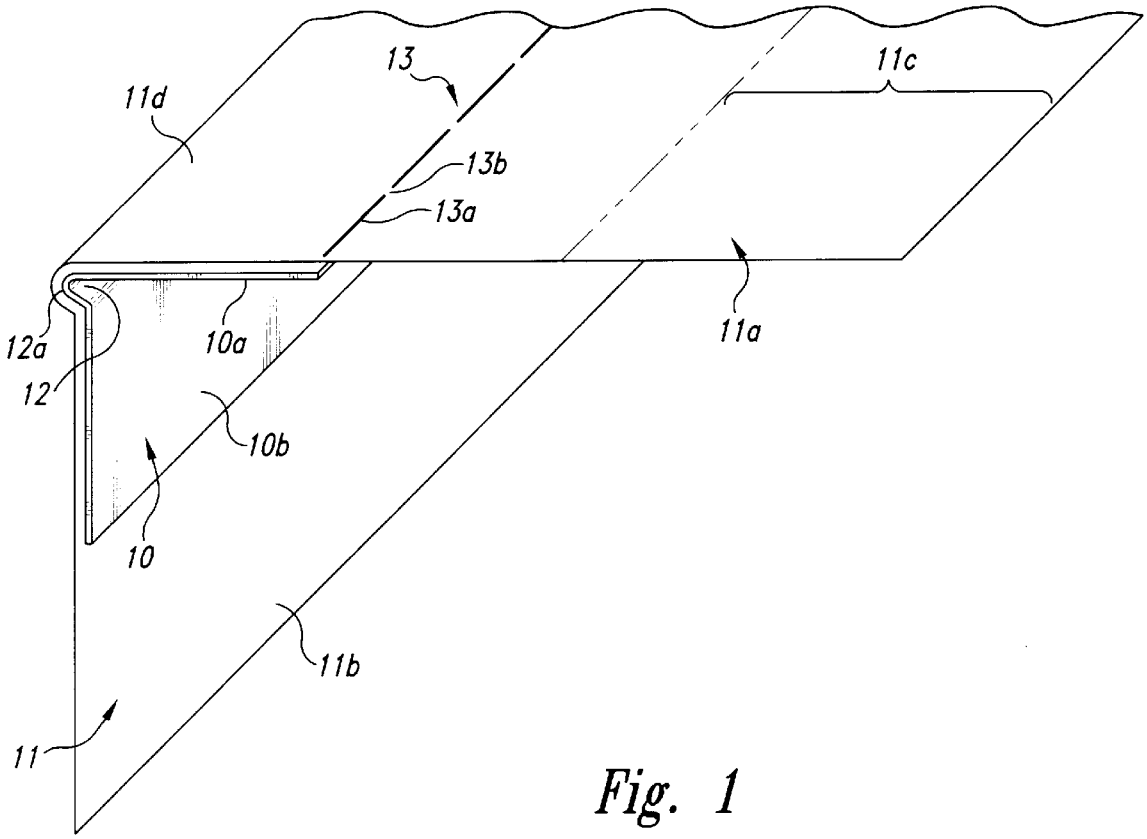
FIG. 1 is a perspective view of a trim strip embodying the present invention. For clarity of illustration in the drawings, the outer paper covering has been shown with single line thickness and spaced from the angle strip, whereas in the actual product the paper covering is bonded to the angle strip.

Referring to the drawings it is seen that a trim member has an angle strip 10 covered by a wider paper cover strip 11 which has wings 11*a*–11*b* extending laterally beyond the outer edges of side flanges 10*a*–10*b* of the angle strip 10. These flanges extend at approximately 90° from an elbow at which a corner rib 12 may be provided having a shoulder 12*a* adjoining flange 10*b*. Typically the flange 10*b* can be about one inch wide and the flange 10*a* has a width preferably about equal to the thickness of the wallboard being used, normally ½" or ⅝". The angle strip 10 is preferably roll-formed from coiled galvanized flat steel stock having a thickness of about 0.010 to 0.014 inch, but may be of a suitable plastic material.

The cover strip 11 may be, for example, 70 to 90 pound bleached Kraft paper like that commonly used for wallboard joint tape. The paper wing 11*b* may be about 1¼ inches wide whereas the wing 11*a* is preferably wider, in the range of about 1¾ to 2¼ inches wide. The width of the wing 11*a* is a combination of the width of the flange 10*a* plus the desired width of a masking extension 11*c*. A central band 11*d* of the paper strip located between the wings 10*a*–10*b* is of a width to cover the flanges 10*a*, 10*b* and the corner rib 12.

In accordance with the present invention, the paper cover strip 11 is perforated along a perforation line 13 which preferably is located at the outer edge of the flange 11*a*. The perforation pattern may be relatively long narrow slits 13*a* separated by relatively short bridges 13*b*. Preferably, these slits 13*a* are pre-cut in the paper stock fed into a roll forming machine for joining by hot melt glue or other suitable adhesive to a continuous core strip following which the product is cut to length.

Figure 2:
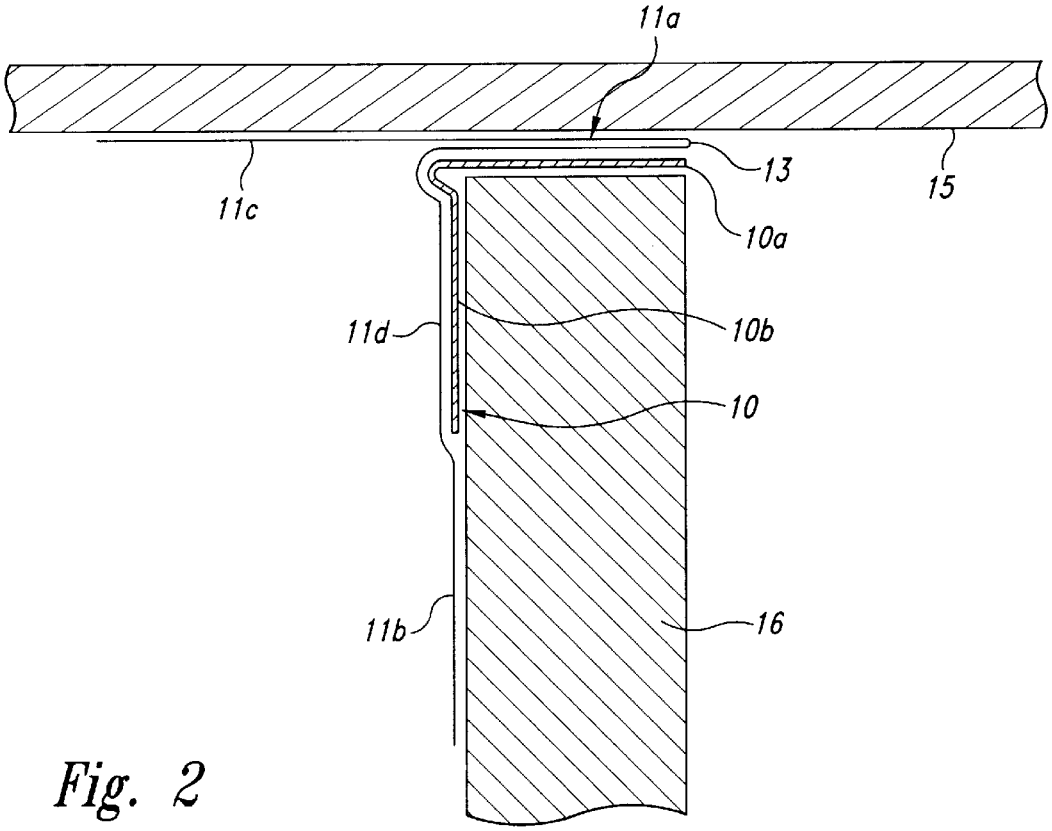
FIG. 2 is a vertical sectional view showing the trim strip mounted in preparation for a finishing operation.
Figure 3:
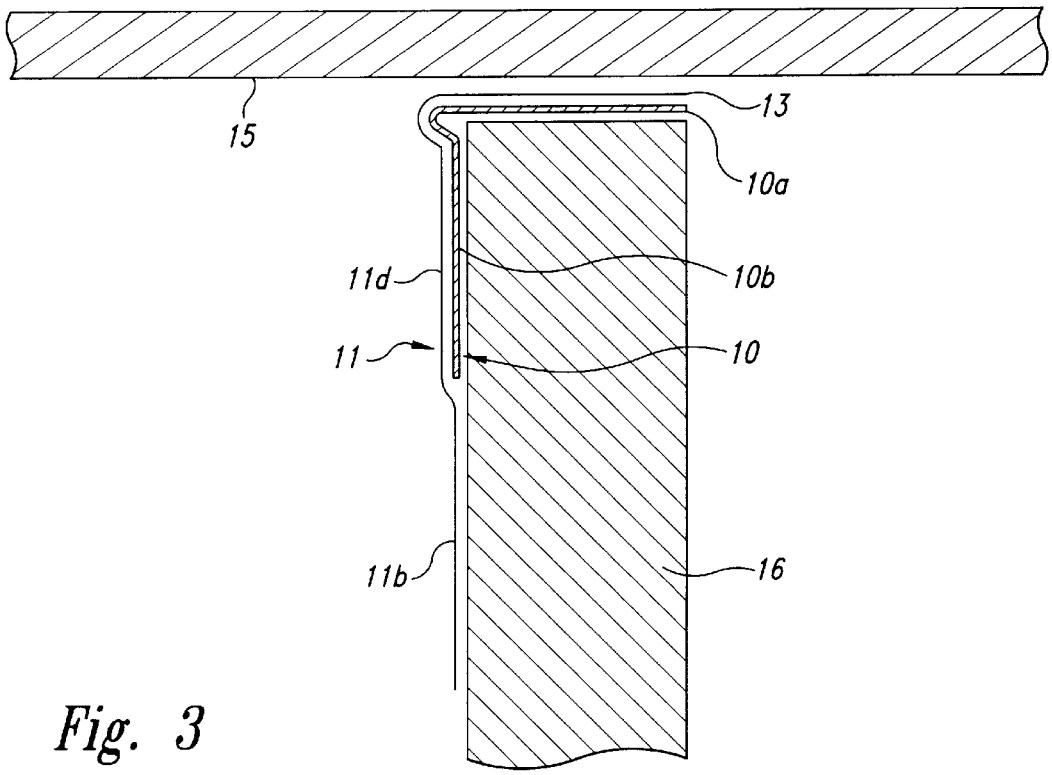
FIG. 3 is a vertical sectional view like FIG. 2, but with the masking extension removed.

For purposes of example, FIG. 2 illustrates a ceiling 15 and a vertical wallboard panel 16 having its upper edge separated by a narrow gap from the ceiling. A trim strip made in accordance with this invention is placed in position with its side flange 10*a* resting on the top edge of the wall panel 16, and its other flange 10*b* resting against the exposed vertical face of the wall panel. Before the positioning of the trim strip, its paper wing 11*a* is folded back at the perforation line 13 over the paper which covers the core flange 10*a* so that when the trim strip is in proper position relative to the wallboard 16, the paper masking extension 11*c* portion of the wing 11*a* projects outwardly from the wall close to the ceiling to mask the ceiling from finishing materials (joint cement or spackle and paint) later applied to the outside of the trim strip below the masking extension. When the finishing is complete the masking extension can be easily removed merely by pulling on it such that the bridges 13*b* are severed along the perforation line 13. As shown in FIG. 3, the paper remaining along this line 13 is completely blocked from view. On the other hand, in the prior art "Jambex Pre-Mask" product previously discussed the masking extension was severed by cutting the paper wing along the elbow at the corner rib 12. This was not only time-consuming and relatively difficult to do without marring the finished surface on the trim strip, and the ceiling surface, but could leave exposed a residual part of the paper at the cutting line.

It will be appreciated that although it is preferred to have the perforation line 16 located at the fold line at the outer edge of the flange 10*a* at which the paper wing 11*a* is doubled back, the perforation line 16 could be located, for example, spaced apart about ⅛ inch or so from the outer edge of the flange 10*a* in which case a hidden narrow tab would remain after the masking extension was removed.

Although the invention has been described applies to a tape-on trim, it will be understood that the paper wing 11*b* could be narrower and folded back beneath the flange 10*b* to cover the outer edge of the flange 10*b* and be bonded to the underside of the flange 10*b*. With this configuration, the trim would be a nail-on trim strip with fasteners being driven through the paper-covered flange 10*b*.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A trim strip comprising:

first and second elongated flanges meeting at an elbow, each of said flanges having an outer face extending laterally from said elbow to a respective outer longitudinal edge;

an elongated paper layer having a first longitudinal portion attached to said outer face of said first flange, having a second longitudinal portion arranged to be doubled back over said first portion, and having an outer longitudinal portion arranged to project laterally from said second portion beyond said elbow to serve as a masking portion;

said paper layer having a longitudinal row of perforations along its length arranged such that said masking portion can be easily removed by pulling thereon when use thereof is completed.

2. A trim strip according to claim 1 in which said row of perforations is adjacent said outer edge of said first flange.

3. A trim strip according to claim 1 in which said paper layer covers said outer faces of said flanges and is bonded thereto.

4. A trim strip according to claim 3 in which said paper layer extends as a wing laterally beyond said outer longitudinal edge of said second flange.

5. A trim strip according to claim 1 in which said perforations comprise elongated slits separated by narrow paper bridges adapted to be severed in response to pulling of said masking portion.

6. A trim strip according to claim 1 in which said row of perforations is spaced laterally away from said elbow.

7. A trim strip comprising:

two elongated flanges meeting at an elbow, each of said flanges extending laterally from said elbow to a respective outer edge;

an elongated tape covering outer faces of said flanges and extending laterally beyond said outer edges as lateral extensions;

one of said extensions being wider than the adjoining flange by the width of an outer masking portion, there being a row of perforations between such extension and the remainder of said tape whereby the extension may be easily removed to remove said masking portion.

8. A trim strip according to claim 7 in which said one extension is doubled back over the adjoining flange with said masking portion projecting laterally beyond said elbow.

* * * * *